US005441068A

United States Patent [19]

Rasch et al.

[11] Patent Number: 5,441,068

[45] Date of Patent: Aug. 15, 1995

[54] SUNSHADE, PARTICULARLY FOR STATIONARY INSTALLATION

[75] Inventors: Bodo Rasch, Leinfelden-Oberaichen; Juergen Bradatsch, Stuttgart, both of Germany

[73] Assignee: SL Sonderckonstruktionen und Leichtbau GmbH, Germany

[21] Appl. No.: 31,796

[22] Filed: Mar. 15, 1993

[30] Foreign Application Priority Data

Feb. 9, 1993 [DE] Germany ..... 43 03 679.1

[51] Int. Cl.[6] ..... E04H 15/28

[52] U.S. Cl. ..... 135/98; 135/20.3; 135/33.2; 135/29

[58] Field of Search ..... 135/16, 33.2, 20.3, 135/48, 98, 99, 29

[56] References Cited

U.S. PATENT DOCUMENTS

| | | | |
|---|---|---|---|
| 2,334,596 | 11/1943 | Bardy | 135/48 |
| 3,177,881 | 4/1965 | Covington | 135/16 |
| 3,444,799 | 5/1969 | Covington | 135/16 X |
| 3,801,809 | 4/1974 | Slade | 135/20.3 X |
| 3,870,062 | 3/1975 | Medlin | 135/20.3 |
| 4,724,882 | 2/1988 | Wang . | |
| 4,848,385 | 7/1989 | Pennella | 135/16 |
| 5,141,010 | 8/1992 | Muller et al. | 135/20.3 |

FOREIGN PATENT DOCUMENTS

| | | | |
|---|---|---|---|
| 2617689 | 1/1989 | France | 135/16 |
| 2808635 | 9/1979 | Germany | 135/16 |
| 4211530 | 10/1993 | Germany | 135/16 |

*Primary Examiner*—Lanna Mai
*Attorney, Agent, or Firm*—Quarles & Brady

[57] ABSTRACT

A large sunshade for stationary installation in squares, courtyards, etc. has, above the sunshade membrane a sunshade linkage with arms, which can be opened and closed by means of spreading arms. On the arms are provided cover flaps, which are upright in the open state and in the closed state flap in wing-like manner to the side and therefore form a closed, fixed sunshade envelope in conjunction with adjacent flaps.

In the central area there are receptacles for the ends of the longer sunshade arms and between which are defined functional areas containing lighting systems, air conditioning openings, etc. By means of a control method with sensors and by means of a control device, the motor opening and closing of the sunshade is controlled in such a way that in permanent operation the microclimate under the sunshade and in particular a group of sunshades is considerably influenced.

21 Claims, 4 Drawing Sheets

SUNSHADE, PARTICULARLY FOR STATIONARY INSTALLATION

BACKGROUND OF THE INVENTION

The invention relates to a sunshade, parasol or umbrella, particularly for stationary installation.

Such a sunshade with a motor drive for the opening and closing functions is described in WO-89/00225. In the latter the sunshade membrane is stretched below the sunshade arms in the form of a lotus flower-shaped cone or funnel. On closing the sunshade the arms pass inwards on the central column and close the membrane, which is normally made from a highly tear-resistant material, between them and optionally the struts supporting the arms. However, in the closed state the membrane is exposed from the outside to light, wind and dirt and is consequently highly stressed. The latter can be greater than in the open state, because although then UV-radiation strikes it, it takes place uniformly over the entire surface. However, particularly the wind loading is high when the sunshade is closed, because the relatively loose membrane then flutters in the wind and can therefore become warm.

OBJECT OF THE INVENTION

One object of the invention is to avoid these disadvantages and in particular protect the sunshade membrane when the sunshade is closed.

Another object of the invention is to use the column for providing functions like lighting and/or cooling the area covered by the sunshade.

A further object is to provide an energy saving method and system to influence the microclimate of an area by using sunshades or the like.

SUMMARY OF THE INVENTION

The invention provides covering means fitted to the sunshade arms, which fold together with the umbrella frame and forms a closed hard cover around the membrane.

The covering means which extend over the lateral faces of the arm can be fixed, but are preferably in the form of pivotable flaps, which in the open position are flapped on the arms, preferably outwards and in the closed position project sideways in wing-like manner and preferably extend to such an extent that with corresponding. cover means of the adjacent arms they form a sleeve comprising fixed elements entirely surrounding the closed sunshade.

The cover means can be motor driven, e.g. by means of independent servomotors. In the case of a drive mechanically derived from the sunshade drive there is no need for separate servodrives, but certain mechanical costs are necessary.

It is particularly advantageous if the movable cover means are progressively drivable during the arm closing movement. This means that the stretching out movement of the cover means which, due to the inward pivoting thereof, also gathers together the sunshade membrane and accumulates it in the inner area, takes place initially, if at all, very slowly, whereas it is sped up shortly prior to the closing process. It is also possible to provide uniform movements, but they must then start in delayed form, so that e.g. the drive of the cover means only starts just before the beginning of the closing process. This can be brought about by electric or hydraulic control, or by means of mechanical drives, e.g. a cam control, dwell mechanism, etc.

Preferably on the cover means and/or the sunshade arms there are membrane fingers, which can be narrow, flexible and usually bent arms, e.g. made from reinforced plastic and which, as a function of requirements, can be fitted where necessary, so as to engage and guide inwards a sunshade membrane area during closing.

As a result of the invention and in-spite of a closed columnar structure, which protects the membrane and terminates same to the outside, the sunshade offers an advantageous optical appearance and fluttering noises on the part of the membrane are avoided and the sunshade drive can be completely automated, so that opening and closing operations can take place substantially without any human influence and monitoring.

Through a construction of functional areas on the sunshade column, between which there are receptacles for the lower ends of the sunshade arms, a number of further advantages are obtained. The sunshade arms located in these receptacles are well guided therein and more particularly in the case of high wind speeds, when sunshades are normally closed, it is ensured that the bearings of the arms are not stressed and consequently the arms do not rattle. It is particularly preferred if in the case of an angular sunshade the longer arms are located in said receptacles. Between the receptacles it is possible for the functional areas to project, whereas the shorter sunshade arms are located above the projecting functional areas. In the functional areas can be provided lighting means, air conditioning openings, etc., which are located at the highest possible point uncovered by the sunshade and therefore can provide an optimum service to the shaded area. It is also possible to incorporate into the sunshade mechanism a pivoting means for lighting fixtures, so as to bring about indirect lighting when the sunshade is open.

Above the area in which the sunshade membrane is fixed to the column, it is possible to provide a separate rain catching membrane, which forms a somewhat flatter funnel or cone in the funnel or cone formed by the membrane. Rain water can be drained off by means of collecting tubes contained in the column. The actual sunshade membrane and its fixing are consequently relieved and simplified. As preferably the fixing to the column takes place by means of straps and the actual membrane does not extend up to the column, it is ensured that rain does not run down the latter.

As the sunshades or parasols can be easily opened and closed without human control despite the considerable surface areas covered, e.g. due to an interconnected rectangular or hexagonal surface design, they are also suitable for influencing the microclimate in the covered area. It is admittedly standard practice to open during the day and close in the evening coverings, such as e.g. garden parasols, awnings, etc., but this normally takes place as a function of daylight, wind, etc.

However, it has been found that according to a feature of the invention a lasting influencing of the microclimate in the shaded area can be brought about if shading takes place as a function of a comparison between heat absorption and emission values. Particularly in regions having limited cloudiness, such as in desert regions, the logical performance of the process leads to astounding results. The shaded areas are not only protected against insolation, as could be expected, but the objects or materials located in this area, e.g. the ground surface has temperatures well above those in a completely shaded area, e.g. an inner area. This is due to the logical utilization of the shielding of irradiation and the allowing of emission, so that the temperature can be lowered to values below ambient temperature. If in said area there are also thermal storage means, e.g. a heat storable floor covering, it is also possible to keep the air temperature in said area low.

Control should take place by means of sensors, which react to the entire range of the thermal radiation to the extent of the energy transmitted by the radiation and detect separately of one another in the inner and outer areas. The measured results are then supplied to a comparator, which leaves the cover, i.e. closes the sunshade in an area to be cooled when emission preponderates over irradiation, or alternatively removes other covering means. It has been found that the use of this process is particularly effective over long periods and large areas. There will be changes in the sunshade opening or closing times if the microclimate changes, e.g. the sunshades are closed somewhat later every day, because the emission from the intermediately cooled area only preponderates over the irradiation at a later time. The opposite takes place in the morning, i.e. the sunshade is opened earlier.

Although such sunshades or parasols are particularly suitable for creating a cooler area in hot regions, said process can also be used for creating a warmer area. Thus, in this case the covering action would be maintained at night and removed during the day. Corresponding areas where, despite a cold climate, frequently emission and irradiation differ considerably between night and day and in spite of this a temperature increase if desired, are frequently encountered in mountainous regions. Therefore the world "sunshade" as used in relation to the invention, means every kind of umbrella-like device independent from its use. This process makes it possible to save considerable energy quantities for cooling or heating and to create a climate, which is free from undesired secondary effects of heating or cooling, such as e.g. draughts and the like.

BRIEF DESCRIPTION OF THE DRAWINGS

These and further features can be gathered from the claims, description and drawings, and the individual features can be realized in an embodiment of the invention and in other fields, either singly or in the form of random subcombinations, and can represent advantageous, independently protectable constructions for which protection is hereby claimed. Embodiments of the invention are described in greater detail hereinafter relative to the drawings, wherein show:

Detailed Description of an Embodiment

Figure 2:
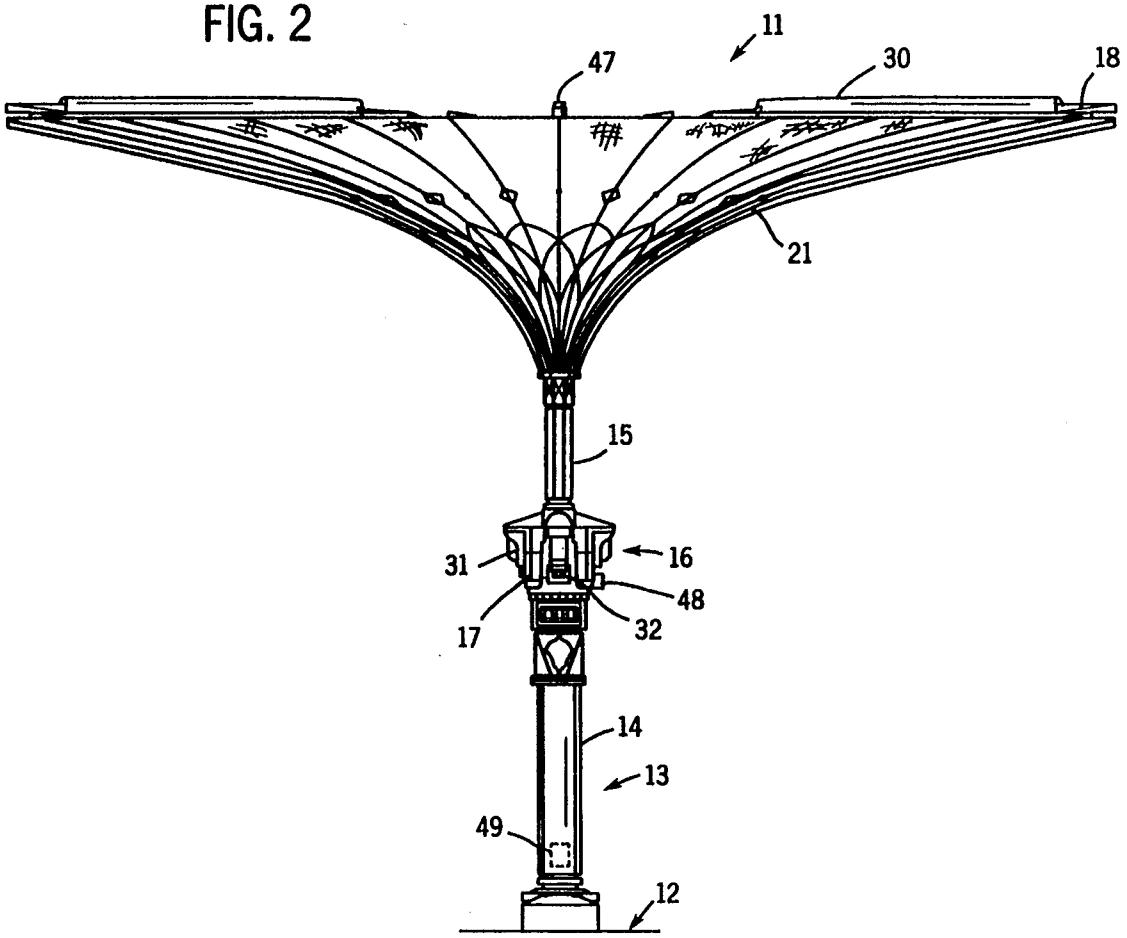
FIG. 2 A sunshade in the open position.

The drawings show a stationary sunshade or parasol intended for covering and in particular shading purposes for public areas in countries having strong insolation. With regards to its opening mechanism, membrane tension, etc. the sunshade corresponds to that shown and described in WO-89/00225 to which reference should be made.

The sunshade 11 has a sunshade column 13 anchored to the ground 12 or to a building and which in the represented embodiment has a lower, thicker part 14 and an upper, thinner part 15, between which there is a thickened region, which houses the functional areas 16 and interposed, recessed receptacles 17 compared therewith.

Figure 5:
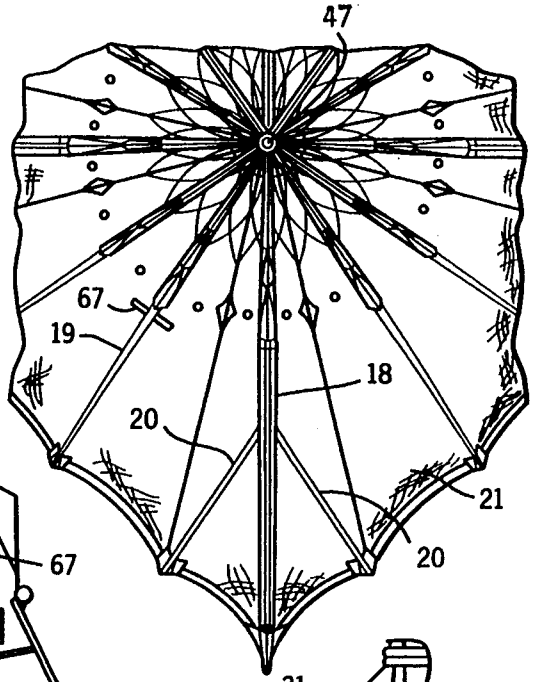
FIG. 5 A partial plan view of an open sunshade.

In the upper area of the sunshade column are articulated sunshade arms. As it is a sunshade with a roughly square sunshade surface, there are long sunshade arms 18 reciprocally displaced by 90° and interposed shorter arms 19. From the long sunshade arms branch passive sunshade arms 20, which do not have their spreading or expanding drive for the better spreading or expanding of the fabric sunshade membrane 21 (FIG. 5).

The sunshade arms are located above the sunshade membrane 21 tensioned in the form of a lotus flower-like funnel or cone. They are supported by spreading or expanding arms 22 (FIG. 9), which are articulated to the column 13 and pass to an articulation or coupling point 23, which is located roughly in the first quarter of the arm, when considered from the column. Actuation takes place by extending an upper telescopic portion 24 of the column, on whose upper end are articulated the arms 18. From the open position shown in thicker line form in which the sunshade arms 18, spreading arms 22 and column 13 form a triangle, on extending the telescopic portion 24 the coupling point 25 of the arm to the column is moved upwards, so that the arm 18 pivots about the articulation point 23 on the spreading arm 22 and during further upward movement carries along said arm 22 inwards onto the column, whereas the outer end 26 of the sunshade arm is moved downwards and towards the column and finally engages close to the column.

In the closed position the sunshade membrane 21 remains below or within the arms 18 and is finally folded up between the sunshade arms, the spreading arms and the column. To ensure that the membrane does not drop too far downwards on loosening, it is braced towards the arm 18 by elastic bracing wires or cables 27 in its central area, but the free shaping of the membrane 21 under tensile stress is not prevented. The membrane and the arms are arranged and dimensioned in such a way that the arms only absorb the pressure stresses. In the vicinity of the outer ends 26 the arms form a tangent on the curved membrane surface.

Figures 9, 10, 11:
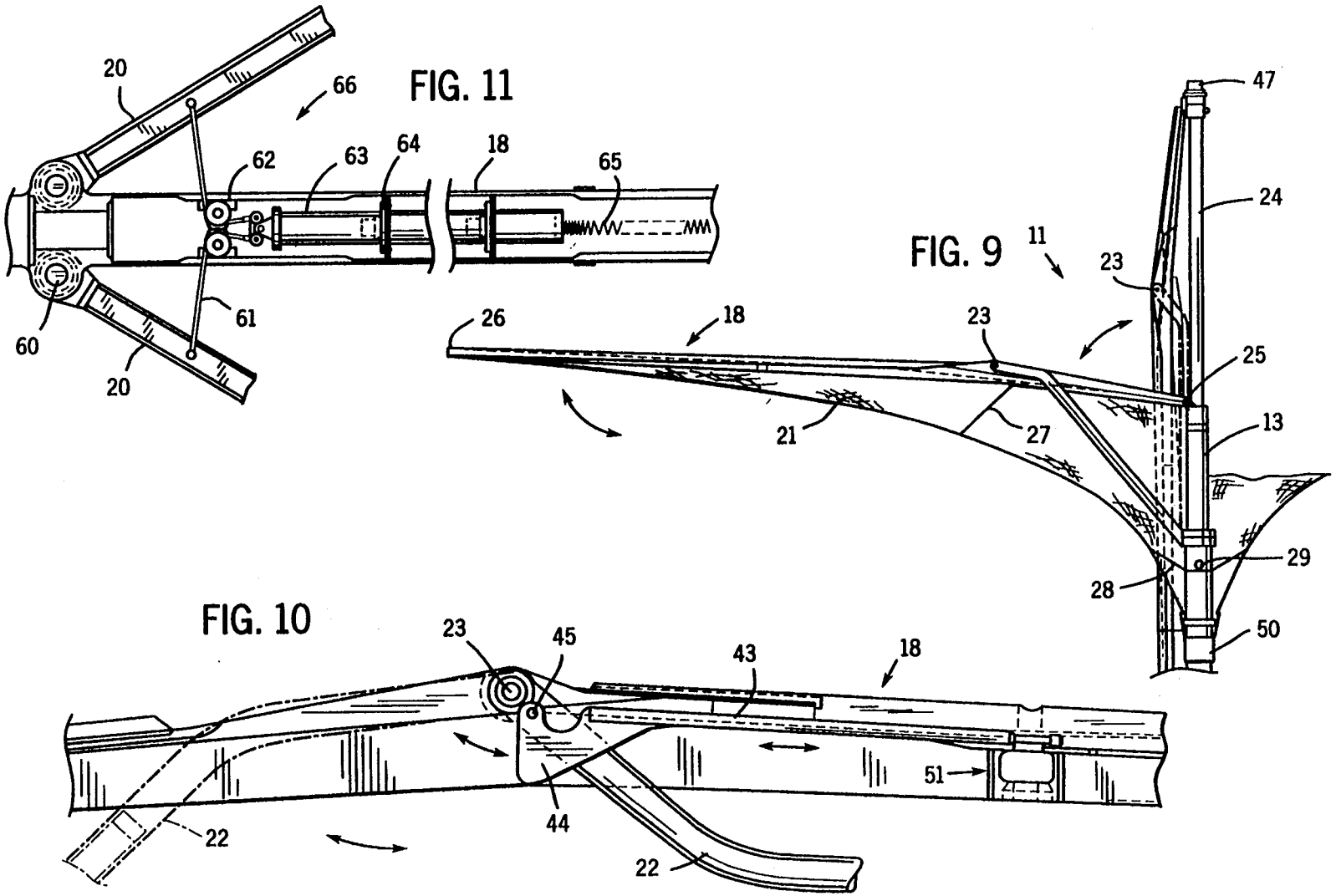
FIG. 9 A side view of a sunshade arm with part of the sunshade column (in thicker line form in the open position and in thin line line form in the closed position).
FIG. 10 A detail of the sunshade arm (thicker lines for the closed position, dot-dash lines for the open position).
FIG. 11 A representation of the articulation of non-driven sunshade arms on one of the main arms.

In the vicinity of the column-near "cup", which forms the membrane 21, a flat, funnel-shaped rain catching membrane 28 is stretched between the sunshade membrane 21 and the column. It traps rainwater dropping into the sunshade and passes it into a draining opening 29 (FIG. 9). However, it also keeps dirt away from the inner cup portion, so that it protects the sunshade mechanism against wet and dirt.

Figure 1:
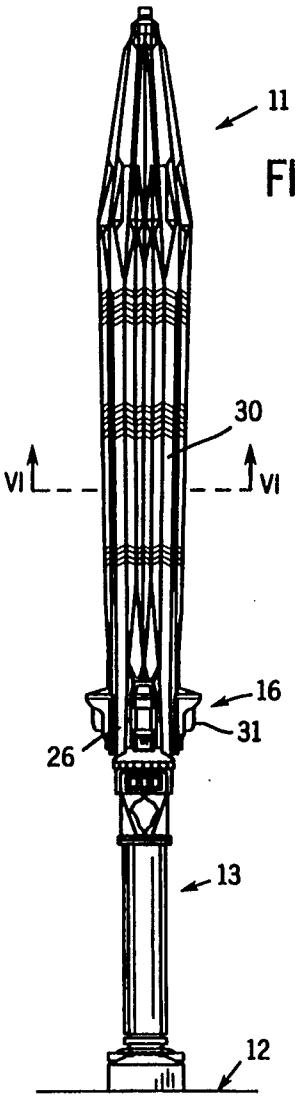
FIG. 1 A side view of a sunshade in the closed position.

FIG. 1 shows that the ends 26 of the long arms 18 in the closed position of the sunshade are located in the four circumferentially provided receptacles 17, which are recessed between the projecting functional areas 16. Thus, the long sunshade arms are mounted and guided in the closed position, which relieves the bearings e.g. under wind loading. The shorter arms 19 end above the functional area 16 and are covered in the closed state by covering means 30, which are fitted to the long sunshade arms 18.

The driving of the sunshade, which can take place electromotively, e.g. by means of a spindle drive, or hydraulically, is housed in the column 13, as are the control mechanics and electrics. The functional areas 16 areas are particularly suitable for the positioning of lamps 31 and air conditioning outlets 32 for lighting and air conditioning the covered area. They are located at the highest point remaining uncovered in the open and closed position. Through the nesting of the functional areas between the long arms the sunshade height can be reduced somewhat e.g. due to the height resulting from the lighting cone and this has an advantageous optical and static effect.

Figure 4:
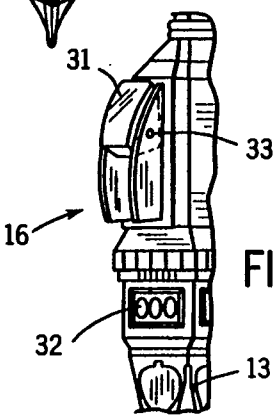
FIG. 4 A variant of the detail IV in FIG. 3
Figure 3:
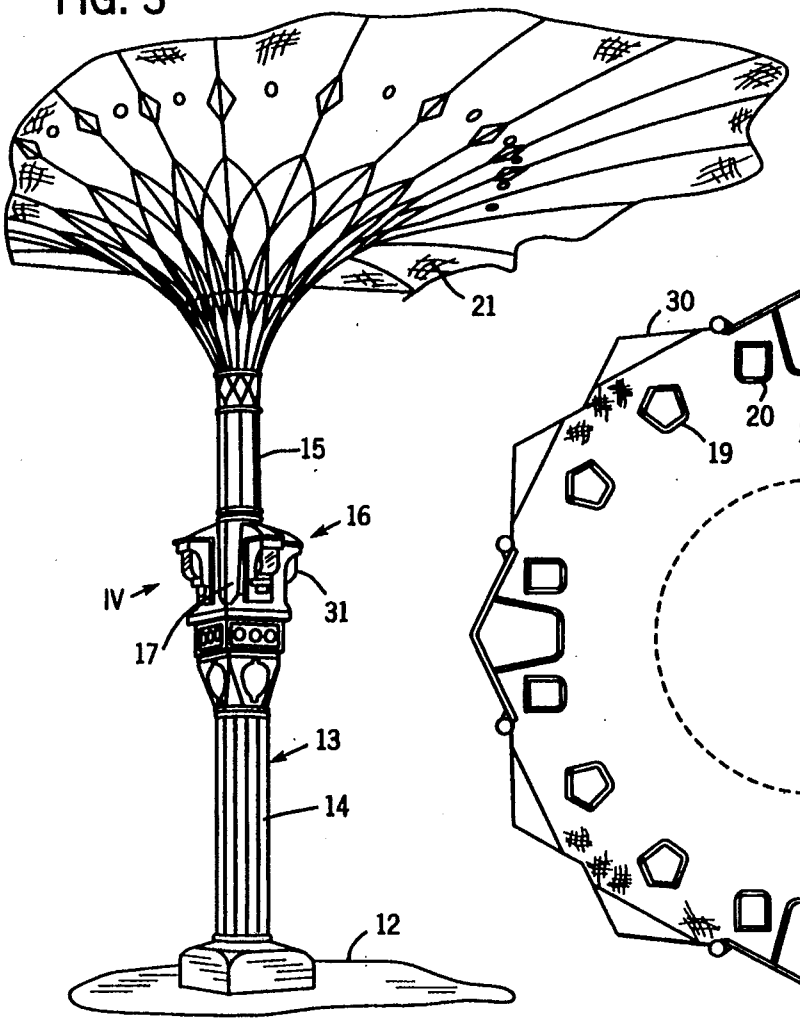
FIG. 3 A perspective view of an open sunshade.

In FIGS. 1 to 3 there are fixed lamps 31 in each of the four functional areas and which emit in downwardly sloping manner. FIG. 4 shows a construction in which the lamps 31 are pivotable about a horizontal pin or axis 33. They are shown in upwardly sloping manner in FIG. 4, where they illuminate the sunshade membrane from below and consequently create an indirect illuminating effect. The drive thereof is advantageously coupled to the sunshade drive, namely either mechanically or by separate servodrives, which are controlled together with the sunshade actuation. Thus, it is possible when the sunshade is open to create an indirect lighting and when the sunshade is closed the lamps, as in the fixed arrangement of FIGS. 1 to 3, can be directed in downwardly sloping manner so as to directly illuminate the area in question.

Figure 6:
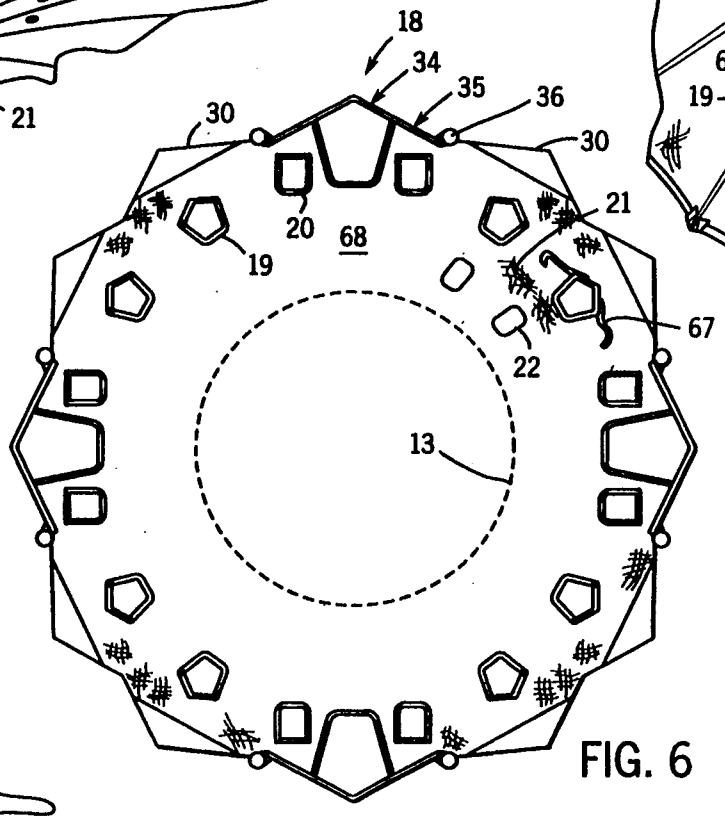
FIG. 6 A diagrammatic cross-section along line VI—VI in FIG. 1.
Figure 7:
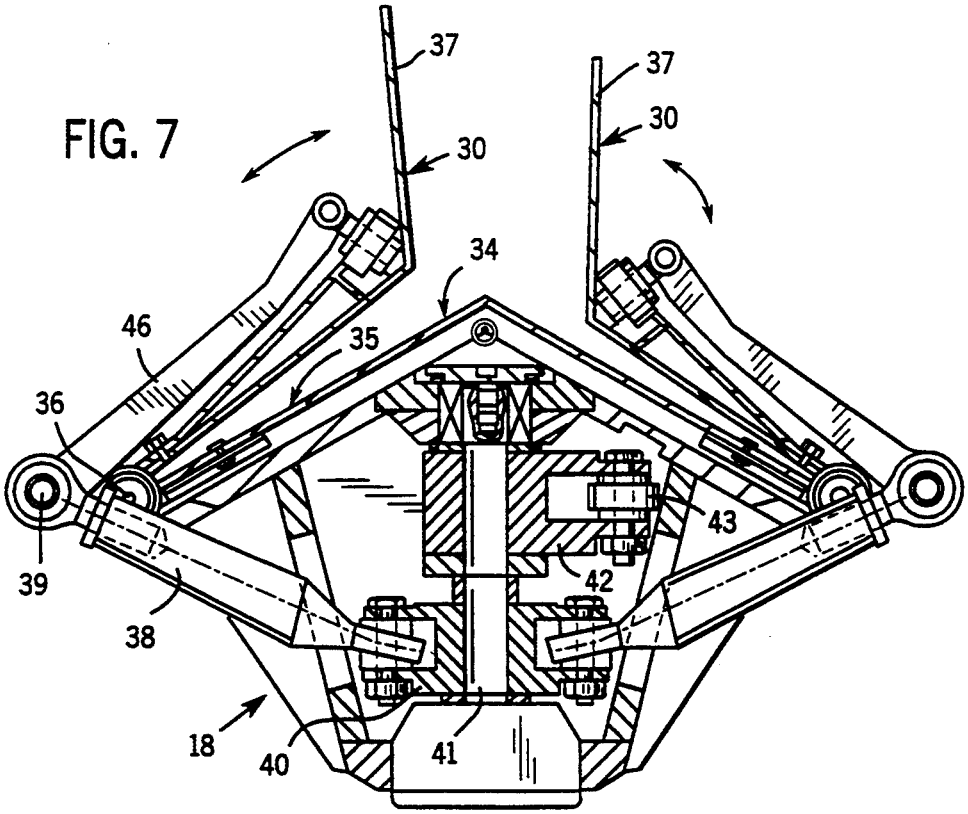
FIG. 7 A cross-section through a sunshade arm with covering means.
Figure 8:
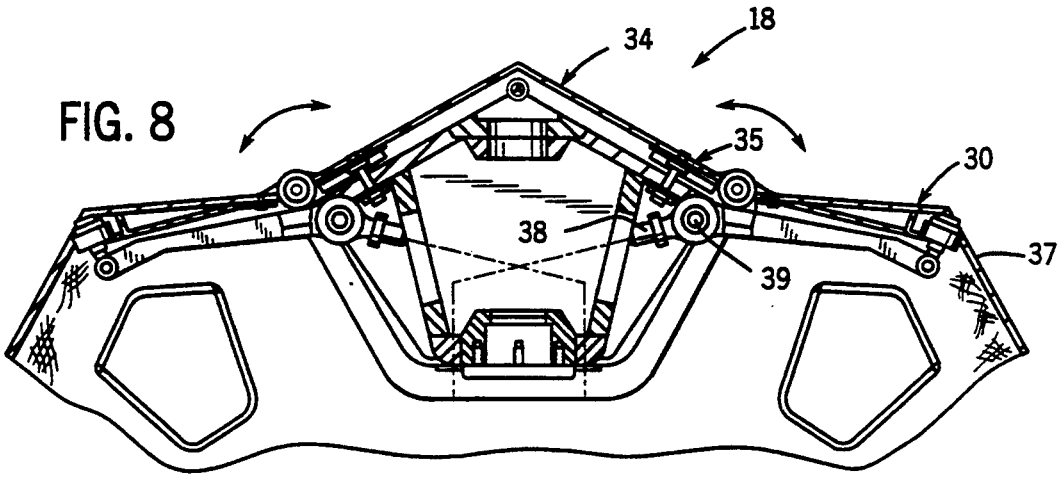
FIG. 8 A cross-section corresponding to FIG. 7 through a sunshade arm in the closed position.

As is in particular apparent from FIGS. 7 and 8, the arms and in particular the long sunshade arms 18, are constructed as pentagonal, welded profiles, whose cross-section roughly corresponds to a gabled house with projecting roof and sloping side walls. The "roof surface" therefore comprises profile outer faces 34 and laterally projecting side covers 35. It covers (FIG. 6) a certain part of the outer circumference of the folded up sunshade. However, a relatively large gap is left between them and in this are located the shorter sunshade arms 19 and the passive arms 20. Gaps are also formed between them, in which the folded up membrane is freely outwardly visible and accessible.

This problem could be partly solved in a not shown embodiment by also providing the short sunshade arms with covering means projecting laterally over the arm, which in certain circumstances can be adequate, particularly if other means ensure that the membrane is effectively located below said covering.

The outer face 34, 35 of the long sunshade arms 18 extends radially further outwards than that of the shorter arms 19, 20. On the lateral edges of the side coverings 35 (FIG. 7) are pivotably arranged the covering means 30 by means of pins 36 running parallel to the arm. They are e.g. plastic or aluminium flaps, which have an angular profile, whose angle is chosen in such a way that in the folded up state (FIG. 6) a columnar profile of the sunshade selected for functional and optical reasons is closed (cf. FIG. 1). Thus, e.g., the surfaces 34, 35 and the outer face of the covering means 30 could be curved arcuately, so that overall a round column is obtained, but this would lead to problems with the arrangement of the then opened flaps 30 in the open position.

FIG. 7 shows that the covering means are so adapted that in the completely opened state (the gaps are shown shortly before the open position) they engage flat on the surfaces 34, 35 of the arm 18 and their angled outer leg 37 projects outwards in the manner of ribs. FIG. 7 shows a construction with two covering means of different sizes on both sides, which can occur in the case of sunshade covering a non-square, e.g. rectangular surface. In this case the long arms extending into the outer corners would form angles diverging from 90° and correspondingly the circumferential portions located between them would be of different sizes.

The flaps are driven by a mechanism shown in FIGS. 7 to 10. In the vicinity of the pivot pins, in each case one push rod 38 is articulated by means of a joint 39 to the flaps 30. It projects through openings in the profile side wall of the arm 18 and namely into the interior thereof and is articulated there on a rotary double crank 40, which is pivotable about a pin 41 by a crank shoulder 42. On the latter is articulated a connecting rod 43, which is positioned within the arm 18 (cf. FIG. 10) and articulated by means of a connecting part 44 to the associated spreading arm 22 of the arm 18 by means of a fulcrum 45.

FIGS. 9 and 10 show that the connecting rod 43 during the movement between the open and closed position and as a result of the pivoting of the spreading arm 22 which occurs is longitudinally displaced between the open position (dot-dash line in FIG. 10) and the closed position (thick lines in FIG. 10). By means of the crank shoulder 42 it pivots the double crank 40 between the open position (FIG. 7), in which the push rods 38 are completely outwards and the covering flaps are located on the profile outer faces 34, and the closed position according to FIG. 8, where the double crank 40 is so pivoted round that it draws the push rod completely inwards and roughly in the extension of the side covers 35 rests on the outer circumference of the folded up sunshade.

The covering means 30 are dimensioned in such a way that the left and right covering means of two adjacent, long sunshade arms 18 are connected to one another virtually without interruption. Correspondingly in the case of a construction with four long arms carrying covering means, they cover an inscribed angle of approximately 20° to 35°, preferably somewhat below 30°, whereas the outer surfaces 34, 35 of each long sunshade arm 18 can cover an inscribed between 25° and 40°, preferably somewhat below 35°. This makes it possible to choose an asymmetrical angle section of the covering means within a shorter outer leg 37 than inner leg, so that the outer leg 37 does not project so far upwards in the open state.

A crank transmission 46 is guided into the kink of the covering flap, which transfers the force to it. The crank arm ratios are determined by the connection of the flap in the vicinity of its pin 36 to the joint 39.

As a result of the quadruple crank transfer or transmission (spreading arm 22/driving rod 43; driving rod 43/crank shoulder 42; double crank 40/push rod 38 and push rod 38/covering flap 30) the transmission ratios are selected in such a way that, on closing, the flap only moves relatively slowly towards the closed position and only shortly before this closed position moves more rapidly towards the position according to FIG. 8. As a result of this progressive movement characteristic in the closed direction, it is ensured that the flap does not impede the folding of the sunshade membrane occurring in the last part of the closing movement and instead shortly prior to closure the resulting folds are gathered up and pressed inwards, so that the membrane is entirely surrounded by the covering means.

FIG. 10 shows that the path of the driving rod 43 close to the open position is small due to its location behind the articulation point 23 and only reaches a maximum close to the open position. A similar effect can be brought about by a corresponding articulation on the remaining crank points. The progressiveness is multiplied, so that it is possible to compensate an opposing crank characteristic, such as e.g. occurs directly on the flap for spatial reasons.

Driving the covering means in direct mechanical derivation from the closing movement is particularly reliable, but requires a certain mechanical expenditure. It can be advantageous to bring about the closing of the flaps by independent servodrives, e.g. electric servomotors, which require relatively small input powers, because plenty of time is available for closing purposes. The desired progressiveness can also be provided. In the case of such servodrives it is also possible to only start up the closing movement when the arms are shortly before or already in the closed position and in this case the flap drive can take place with a uniform speed.

FIG. 6 shows that for the covering flaps 30 provided on the four long arms 18 on each side the closed sunshade has a closed outer surface, which is shaped like a short twelve-pointed star. The flaps can extend over the entire length, but can also be provided in several portions, e.g. in order to follow a slightly bent extension of the arms 18.

FIG. 6 also shows that membrane fingers 67 are fitted to one of the shorter arms 19. They can be flexible plastic fingers, which are appropriately curved in order to store the membrane on closing the arms in the space 68 provided for membrane storage between the collapsed arms and the column 13. These membrane fingers 67 can be provided on random points of the arms 18, 19, 20 or optionally also on the flaps 30. As indicated in FIG. 6, they can have a closed profile, which increases the twisting rigidity thereof and partly covers the mechanisms.

FIG. 11 is a plan view of a long arm 18 showing the articulation point of the passive arms 20 (cf. FIG. 5). On collapsing the sunshade it must be ensured that it is uniformly, carefully and in controlled manner applied to the arm 18. At some distance from the articulation points 60 there is a pulling means, e.g. a cable 61 on each passive arm 20 and which runs in arm 18 by means of cable pulley 62. Both cables 61 are interconnected and fixed to a weight 63, which runs in the arm and is guided in shock absorbing guide bushes 64. In addition to the weight a tension spring 65 is provided, which acts in the same tension direction as the weight. In the open state only the tension spring acts on the stretching device 66, because the arm 18 is horizontal and correspondingly there is no tensile force of the weight 63. However, if the sunshade is closed, the arm has an increasing tendency towards its outer end 26, so that the weight now increases the spring tension 65 and therefore laterally draws the passive arms 20 over the cable 61 on the arm 18. Both arms are moved synchronously. When open the spring 65 maintains a certain minimum pre tension, so as to keep the cables taut.

It is possible to achieve the desired effect by other means, namely a force which progressively increases on closing for bringing in the passive arms, e.g. by combination with gas springs or the like. It would be preferable to provide a damping effect of known type, e.g. in the form of a shock absorber, so as to ensure that the arms are not suddenly drawn in. In the case of the use of a gas spring it could be integrated into the latter. For such a case it could also be advantageous to bring about the tensile connection between the passive arm 20 and the main arm 18 by a pressure-transferring medium, e.g. the gas spring.

The sunshades according to the invention are particularly suitable for covering large surfaces, such as public precincts, courtyards, etc. and as a result of the rectangular shape there is an almost uninterrupted transfer between juxtaposed sunshades. By a corresponding control a special effect is possible, which leads to a surprisingly energy-saving effect in areas having only limited cloud cover. If the insolation and irradiation from the earth, e.g. from the floor or ground 12 is carefully monitored and the absorption and emission values are compared with one another and as a function thereof the floor is protected against radiation or the shielding cover is removed, e.g. by opening and closing a sunshade, then the climate can be considerably impaired. Thus, if in the case of preponderant irradiation the sunshade is opened and then immediately closed when emission preponderates, then under such climatic conditions as e.g. occur in desert areas, the climatic conditions in the zone below the sunshade can differ very considerably from the surrounding climatic conditions and render superfluous energy-consuming artificial air conditioning. This effect is particularly marked if this procedure is used for a long period and the area located below the cover is shielded against convection heat transfer. In such cases the night emission under cloudless skies and despite the desert climate can keep the overall temperatures at a pleasant level.

In the represented embodiment radiation sensors 47, 48 are provided for this purpose, the sensor 47 being located on the upper end of the column 13, i.e. above the sunshade, and the axis of its radiation reception cone is directed vertically upwards, whereas the sensor 48 is fitted to part of the column below the sunshade and monitors the emission of the parts located below the sunshade, i.e. the ground 12. Several sensors can be located at different points. The values measured by the radiation sensors and whose spectrum not only covers the energy component of visible light, but in fact the entire thermal radiation in accordance with the energy content thereof, are processed in a control unit 49 containing a comparator (FIG. 2), which is e.g. locatable in the column. As a function of this comparison the sunshade drive 50 is put into operation (of. FIG. 9). It would naturally also be possible to provide manual or programme-controlled action possibilities, so as e.g. not to disturb an event by the opening and closing of the sunshade, but generally the operation should take place as a function of the radiation comparison.

The process is particularly effective if in the area climatically influenced in this way thermal storage means are provided, e.g. by the choice of a floor material having a high specific thermal capacity. Here, in the case of a longer application of the process, a reservoir in the form of a cold store can be created. The process functions in the same way and by merely acting on the control system for both cooling and heating. For heating it is merely necessary to open the shade covering when irradiation preponderates and close it in the opposite case.

We claim:

1. A sunshade comprising:

a sunshade column;

movable sunshade arms supported by said sunshade column;

drive means operatively connected to said sunshade arms for driven movement of said sunshade arms between an open position and a closed position;

a sunshade membrane extendable by said arms for movement between said open position and said closed position, wherein in the closed position the membrane has folds that are received between said sunshade arms; and a plurality of cover elements disposed above the membrane and the sunshade arms in the open position, wherein said cover elements are moved to a position to cover and enclose the sunshade membrane when the sunshade arms are moved to the closed position.

2. The sunshade according to claim 1, wherein when the sunshade arms are in the open position, the sunshade membrane is stretched below the sunshade arms.

3. The sunshade according to claim 1, wherein the cover elements are flaps that are pivotable about axes substantially parallel to the sunshade arms.

4. The sunshade according to claim 1, wherein the drive means comprise motor-operable drive means.

5. The sunshade according to claim 4, wherein the cover elements and the sunshade membrane are both linked with the drive means.

6. The sunshade according to claim 5, wherein the drive means comprises crank and push/pull rods, which accelerate closing movement when approaching the closed position.

7. The sushade according to claim 1, wherein the cover elements, when the sunshade is in the closed position, substantially continuously surround the membrane.

8. The sunshade according to claim 1, wherein the cover elements are provided on respective sunshade arms driven by the said drive means and also cover other sunshade arms.

9. The sunshade according to claim 1, wherein the sunshade arms have an outer covering surface with an angular or curved profile.

10. The sunshade according to claim 1, wherein in the closed position, the covering means and the outer surfaces of the sunshade arms form a column having a polygonal cross section.

11. The sunshade according to claim 1, wherein the cover elements have surface portions, which in the open position are located over outer surfaces of the sunshade arms.

12. The sunshade according to claim 1, wherein the cover elements are fitted to lateral edges of a sunshade arm in the open position, with surface portions projecting outwards from said arms.

13. The sunshade according to claim 1, wherein the cover elements are progessively drivable during closing movement of the arms.

14. The sunshade according to claim 1, wherein the sunshade arms have lateral coverings projecting laterally over outer surfaces of the sunshade arms forming at least a part of the covering means.

15. The sunshade according to claim 1, wherein the sunshade is in the form of a stationary parasol.

16. The sunshade according to claim 1, wherein the cover element for a respective sunshade arm are, in the closed postion, closely adjacent to the cover element of an adjacent one of the sunshade arms.

17. A sunshade comprising:

a sunshade column;

movable sunshade arms supported by said sunshade column;

drive means operatively connected to said sunshade arms for driven movement of said sunshade arms between an open position and a closed position;

a sunshade membrane extendable by said arms for movement between said open position and said closed position, wherein in the closed position the membrane has folds that are received between said sunshade arms; and wherein membrane grasping fingers are provided on said sunshade arms and formed by flexible, curved fingers, which during closing movement of the sunshade arms gather up the sunshade membrane and pass it into a collapsed position.

18. A sunshade coomprising:

a sunshade column;

sunshade arms, movable between an open and a closed position; and a sunshade membrane extendable by said sunshade arms;

wherein said sunshade column has a circumferential portion with devices including lights and air conditioning outlets alternated with receptacles for receiving ends of the sunshade arms when moved to the closed position.

19. The sunshade according to claim 18, the sunshade having relatively longer sunshade arms alternating with relatively shorter sunshade arms, said relatively longer sunshade arms being received in the receptacles, while said relatively shorter sunshade arms terminate above the receptacles.

20. The sunshade according to claim 18, wherein said circumferential portion projects radially outwards from the column, wherein the receptacles form pockets in the circumferential portion for receiving parts of the sunshade arms, and wherein the receptacles are, in the closed position, covered by the cover elements which are fitted to the sunshade arms.

21. The sunshade according to claim 18, wherein the lights include lamps, which are oriented for illuminating the area covered by the sunshade and are pivotable by a lamp drive coupled to the sunshade drive means into a position illuminating the membrane when open.

* * * * *

UNITED STATES PATENT AND TRADEMARK OFFICE
CERTIFICATE OF CORRECTION

PATENT NO. : 5,441,068

DATED : August 15, 1995

INVENTOR(S) : Rasch, et al.

It is certified that error appears in the above-identified patent and that said Letters Patent is hereby corrected as shown below:

| | |
|---|---|
| Col. 1, line 49 | After "corresponding" the "." should be deleted. |
| Col. 2, line 9 | After "in" the "-" should be deleted. |
| Col. 3, line 35 | "World" should be --word--. |
| Col. 4, line 28 | After "their" the word --own-- should be inserted. |
| Col. 5, line 17 | The word "areas" should be deleted. |
| Col. 6, line 55 | After "inscribed" the word --angle-- should be inserted. |
| Col. 8, line 60 | "(of FIG. 9)" should be --(cf. FIG. 9)--. |
| Col. 9, line 44 | "sushade" should be --sunshade--. |
| Col. 10, line 33 | "coomprising" should be --comprising--. |

Signed and Sealed this

Twenty-sixth Day of March, 1996

*Attest:*

Bruce Lehman

BRUCE LEHMAN

*Attesting Officer*

*Commissioner of Patents and Trademarks*